US005729794A

United States Patent [19]

Schwallie et al.

[11] Patent Number: 5,729,794

[45] Date of Patent: Mar. 17, 1998

[54] TONER CONTAINER HAVING A WEB SEAL

[75] Inventors: Scott H. Schwallie; Ronald R. Holland, both of Rochester; Linn C. Hoover, Webster, all of N.Y.

[73] Assignee: Eastman Kodak Company, Rochester, N.Y.

[21] Appl. No.: 650,673

[22] Filed: May 20, 1996

[51] Int. Cl.[6] ..... G03G 15/08

[52] U.S. Cl. ..... 399/106; 399/98

[58] Field of Search ..... 399/98, 102, 103, 399/106, 252, 262, 258; 222/DIG. 1; 141/85, 89, 363, 364

[56] References Cited

U.S. PATENT DOCUMENTS

| | | | |
|---|---|---|---|
| 4,062,385 | 12/1977 | Katusha et al. | 141/89 |
| 4,895,104 | 1/1990 | Yoshino et al. | 399/106 |
| 4,997,016 | 3/1991 | Hacknauer et al. | 141/363 |
| 5,018,560 | 5/1991 | Tsukamoto | 141/364 |
| 5,313,993 | 5/1994 | Corby et al. | 141/364 |
| 5,404,212 | 4/1995 | Ditomaso | 399/106 |
| 5,555,080 | 9/1996 | Elich et al. | 399/262 |

*Primary Examiner*—Sandra L. Brase
*Attorney, Agent, or Firm*—Leonard W. Treash, Jr.

[57] ABSTRACT

A toner container has an opening through which toner is dispensed. It is covered by a web seal which is removable by an operator to dispense the toner. A cleaning edge is positioned to engage the seal as it is removed and clean toner off the seal to prevent its soiling the hands or clothing of an operator removing it.

5 Claims, 3 Drawing Sheets

TONER CONTAINER HAVING A WEB SEAL

This invention relates to a container for toner of the type used in copiers and printers. More specifically, it relates to toner containers of the type containing a web seal across a dispensing opening.

U.S. Pat. No. 4,062,385, issued Dec. 13, 1977 to Katusha et al, shows a toner container having a containing portion with a base. The base has an opening facing downward in use and a flange extending outward from the opening. A cover is slidably secured to the flange. A receiving apparatus for the container includes a sump for receiving toner through the base of the container when the opening of the container is positioned directly above it. The container with the cover is positioned beside the sump, and the container portion is slid off the cover and over the sump with the flange sliding on a receiving surface that surrounds a sump opening. A web seal, generally of plastic or paper, attaches to the underside of the flange around the opening, is folded once and then extends between the cover and flange to a position outside the container where it may be grasped by an operator and removed to release the toner into the sump. The web seal is discarded, but the containing portion is moved back over the cover after the container is emptied to prevent the escape of residual toner in the toner container during removal and further handling in recycling the container.

U.S. Pat. No. 4,997,016 issued Mar. 5, 1991, to Hacknauer et al, shows various improvements to the basic structure shown in the Katusha et al patent. Of particular interest is that the container is placed directly over the sump and the cover is moved away from the sump and container to uncover the opening. Again, a double-back web seal, similar to that in Katusha et al, is removed after uncovering of the dispensing opening by the cover.

In each of the above structures the container is locked to the sump by sliding the flange surrounding the base opening of the container into slots in the receiving apparatus. U.S. Pat. No. 5,313,993, issued May 24, 1994 to Corby et al, is representative of a number of other toner containers in which the container is positioned directly down on top of the sump and otherwise held, rather than being slid into position.

Most toner bottles which presently dispense toner by being attached to the apparatus, use some sort of web seal. Although some of the web seals are replaced over the opening when the bottle is removed, such structures are complicated. Thus, in most instances, the seal is totally removed at opening. Because a portion of the web seal was in contact with toner until removed, toner sticking to that part of the seal can soil the hands of the person removing the seal or be displaced into the air or equipment outside the sump.

SUMMARY OF THE INVENTION

It is an object of the invention to reduce the amount of toner removed from the sump and container area by movement of the seal away from the opening.

This and other objects are accomplished by a toner container including a containing portion for containing toner and having an opening through which toner can be dispensed, a web seal in a sealing condition over the opening and removable by movement of the web seals in a first direction, and means defining a cleaning edge positioned to engage a surface of the web seal as the web seal moves in the first direction to clean toner off the web seal as it is being removed.

According to a preferred embodiment, the toner container includes a flange associated with the opening and extending at least in the first direction from the opening, a cover slidable in the first direction to uncover the opening with the web seal between the flange and the cover. One of the cover and the flange have a protrusion defining the cleaning edge.

According to a further preferred embodiment, one end of the web seal is fastened to the surface of the flange. The web seal is folded and then extends in the first direction to a position sufficiently outside the container to be grasped by the operator. The cover contains, on its upper surface a rib-shaped protrusion defining the cleaning edge and engaging the lower surface of the web seal as it is removed. The lower surface, because of the fold, is the surface contacting the toner when in the sealing condition. Preferably, a pair of mating ribs on the flange contact the opposite side of the web seal and force it against the rib-shaped protrusion on the cover. The ribs or protrusions on the flange and cover are positioned to cooperate to clean the web seal when the cover is in its uncovering or open position.

With the preferred embodiments, a large percentage of any toner that has a tendency to stick to the web seal as it is removed is cleaned off the web by the cleaning edge and ultimately pushed back into the container or sump when the cover is returned to its covering position.

DETAILED DESCRIPTION OF THE INVENTION

Figures 1, 2, 3:
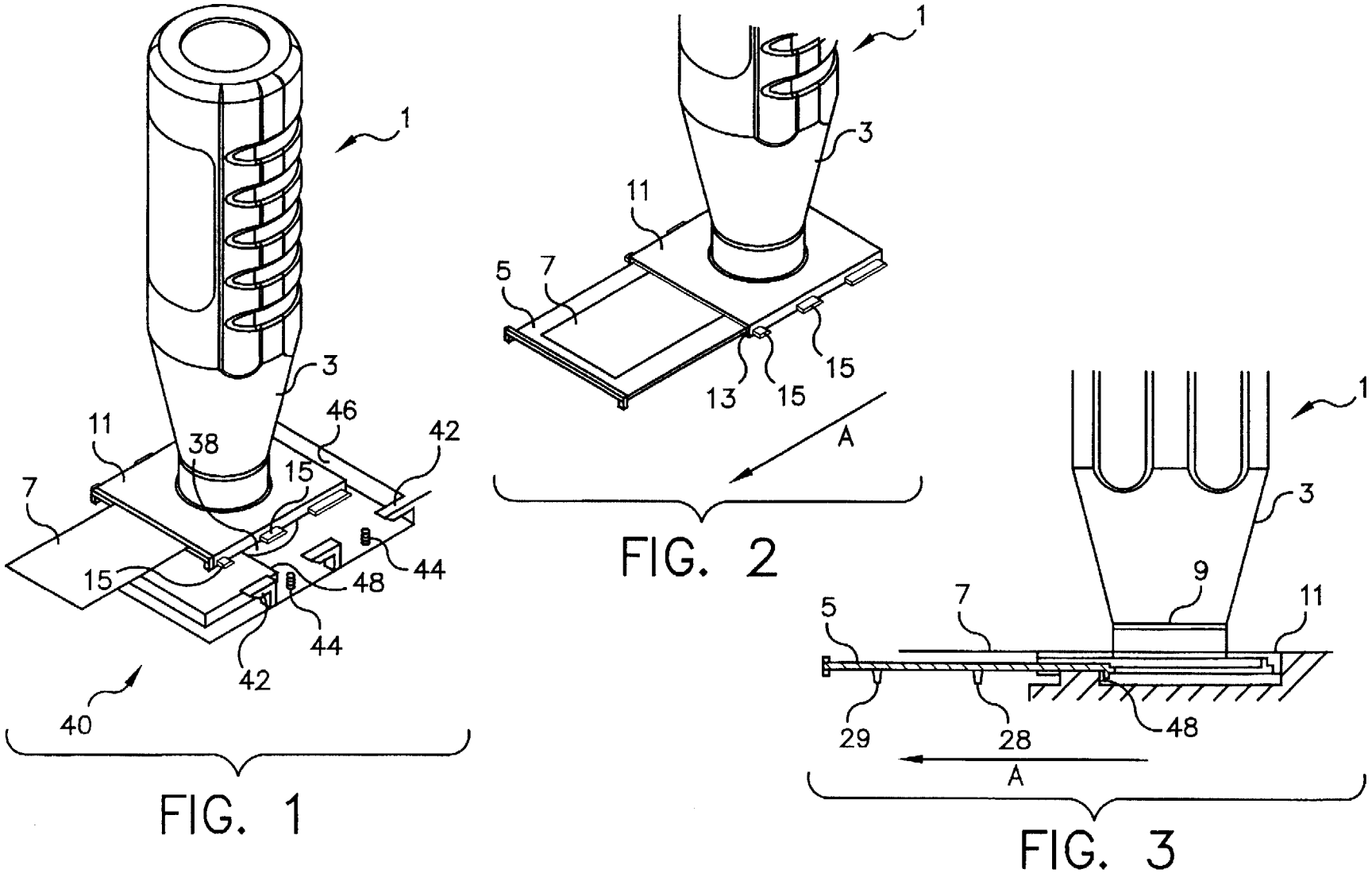
FIGS. 1 and 2 are perspective views of a toner container.
FIG. 3 is a side view of a toner container.
Figure 4:
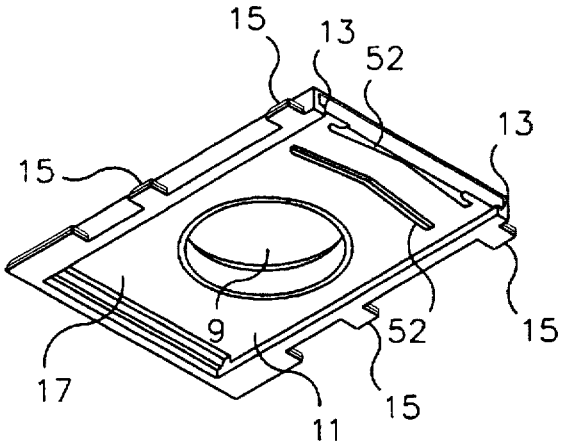
FIGS. 4, 5 and 6 are perspective views of a containing portion, cover and containing portion with the cover, respectively, of a toner container.
Figure 6:
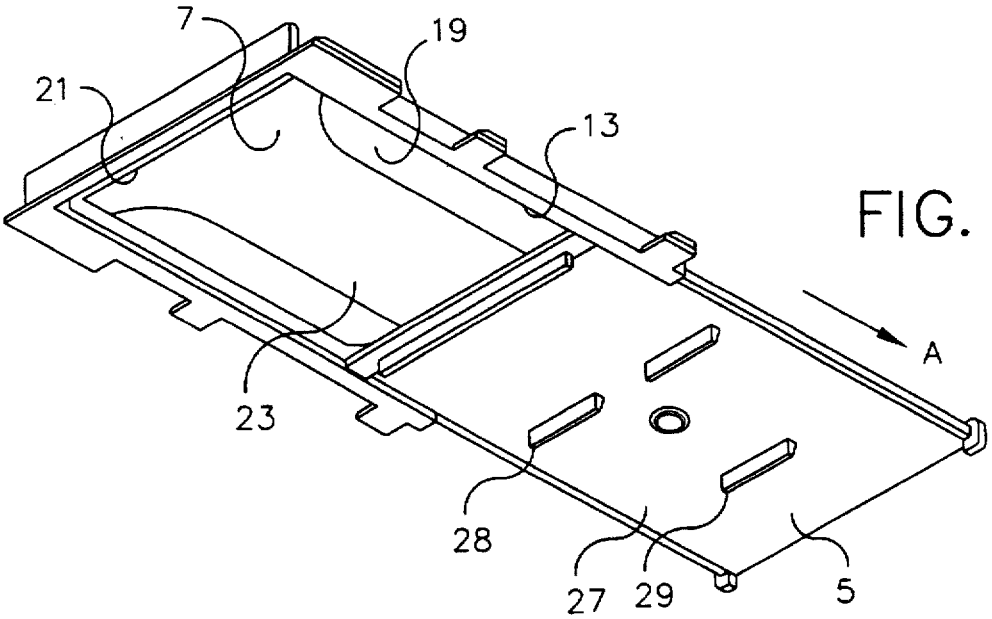

FIGS. 1–3 show a toner container 1 (sometimes herein called a "toner bottle") which includes a containing portion 3, a cover 5 and a web seal 7. The bottom of the containing portion 3 has an opening 9 (FIGS. 3, 4 and 7) through which toner can be dispensed. A flange 11 surrounds the opening 9 and includes a lower surface 17 (FIG. 4). As best seen in FIG. 6, web seal 7 has a sealing portion 19 adhesively affixed to lower surface 17 of flange 11. It is folded at a fold 21 and has an extended portion 23 doubled back over the sealing portion 19 and extending outside of the bottle between the cover 5 and flange 11, as best seen in FIG. 1.

Cover 5 slides in guides 13 on flange 11 from a position shown in FIG. 1 covering opening 9 in a first direction defined by an arrow A to a position shown in FIG. 2 (also FIGS. 3 and 6–9) uncovering opening 9. Cover 5 has lugs 28 and 29 extending downward upon which the bottle can rest on a flat surface when outside a copier or printer, or which can be engaged by a shutter-handle (not shown) in the receiving apparatus for assistance in opening and closing the cover.

In operation, toner container 1 is secured to a toner container receiving device 40 over a sump 38 by vertically moving container 1 downward toward sump 38. Seating lugs 15 on the sides of flange 11 fit between receiving hooks 42 on receiving device 40. Flange 11 and container 1 are pushed backward toward a backwall 46, aided by cam surfaces on both lugs 15 and hooks 42. Lugs 15 fit behind hooks 42 and are pushed against hooks 42 by an elastomer gasket or springs 44 to seat container 1 over sump 38 in a manner generally known in the art.

Figure 7:
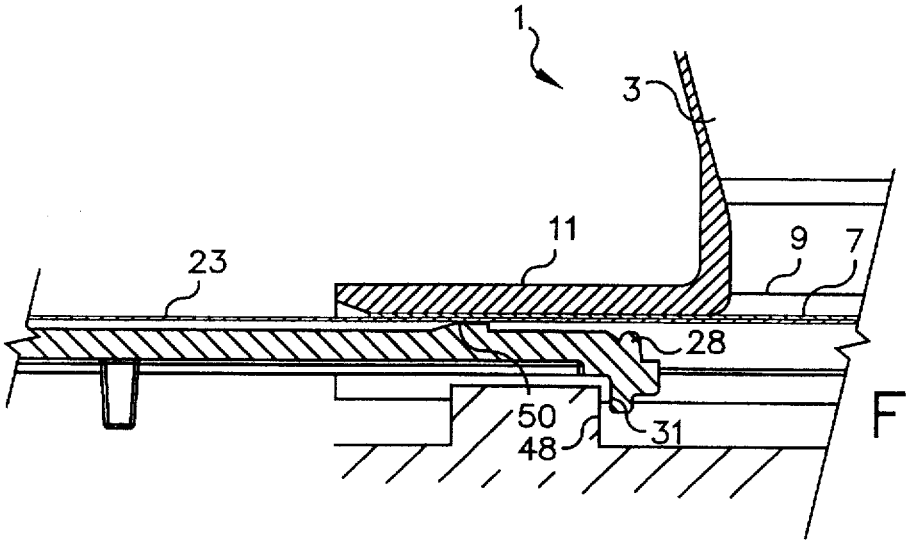
FIGS. 7, 8 and 9 are sections of a portion of a base, cover and seal of a toner container.
Figure 8:
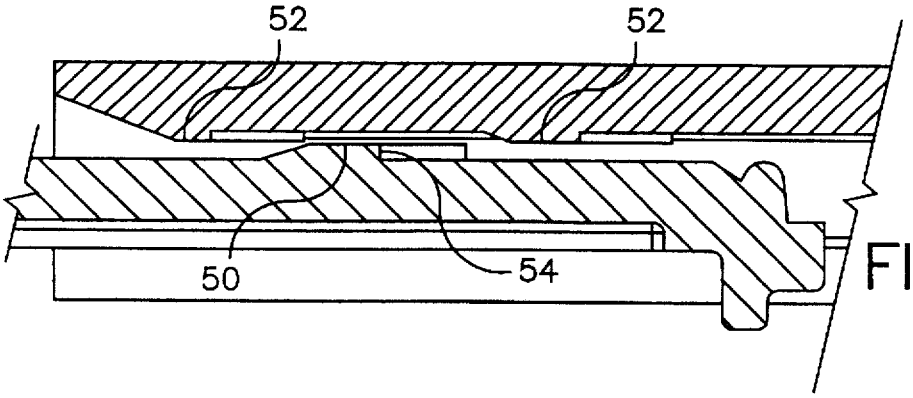

Cover 5 is pulled by the operator in the first direction (arrow A) until a vertical stop surface 31 on the rear of cover 5 engages a cover stop surface 48 on receiving device 40 (see FIGS. 3 and 7). A locking detent 28 to the rear of cover 5 is overcome in the initial movement of cover 5. At this point, web seal 7 is pulled by the operator, also in the first direction, releasing the toner in containing portion 3 through opening 9 into sump 38. Although seal 7 could be left partially attached to the portion of lower surface 17 of flange 11 extending in the first direction away from opening 9, it is preferably removed entirely and discarded.

When it is desired to remove the toner bottle from its position over the sump, for example, when it is empty, the cover 5 is moved in a direction opposite to the first direction to a position again covering opening 9, and the container 1 is moved in the first direction to unhook seating lugs 15 from hooks 42, allowing the toner container 1 to be moved vertically away from sump 38 and ultimately cleaned and recycled.

Figure 5:
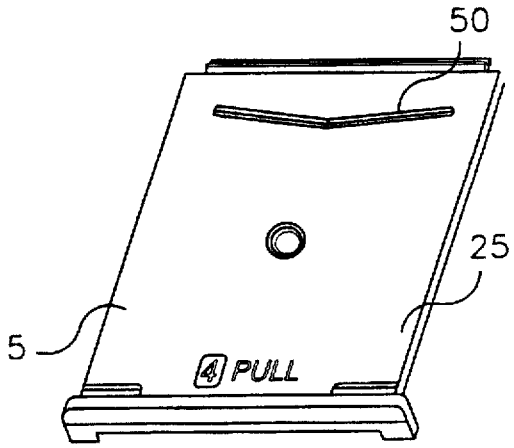
Figure 9:
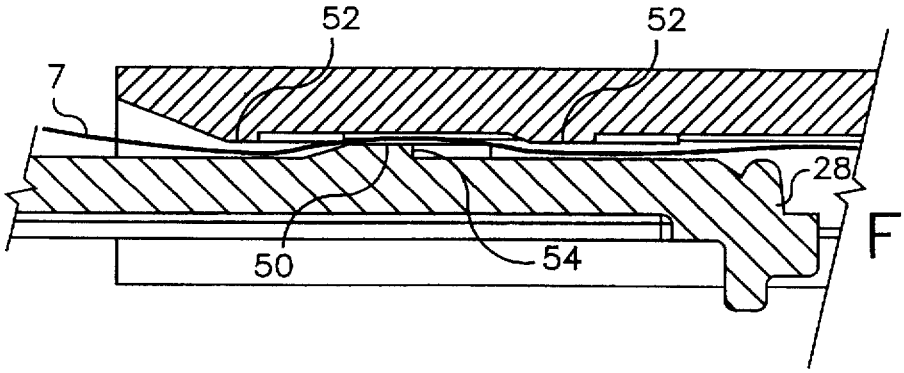

The sealing portion 19 of web seal 7 contacts toner throughout its life over the opening and until removed in the process described above. Toner picked up from such contact can soil the hands of the person removing the seal or be dislodged from the seal into the rest of the copier or printer. To prevent this, a rib-shaped protrusion 50 on cover 5 defines a cleaning edge 54 (FIG. 8) which is positioned to scrape the bottom surface of seal 7 as it is pulled out of the container 1. The elongated shape of protrusion 50 is best seen in FIG. 5, while its interaction with web 7 is best seen in FIG. 9. To enhance the effect of the cleaning edge 54 on rib-shaped protrusion 50, mating rib-shaped protrusions 52 on the lower surface 17 of flange 11 are positioned to force web seal 7 more into engagement with cleaning edge 54. The protrusions 52 and 50 force web seal 7 through a tortuous path which enhances the cleaning effect of cleaning edge 54.

After web seal 7 has been removed and discarded, the movement of cover 5 back to its covering position pushes toner scraped off web seal 7 by protrusion 50 back into sump 38 or containing portion 3. Any that remains on cover 5 is less likely to soil the person or clothing of an operator than had it remained on the web seal 7.

The cleaning action of cleaning edge 54 is most effective if protrusions 50 and 52 are somewhat V-shaped, preferably with the V pointed in the first direction, as shown best in FIGS. 4 and 5. This provides a small amount of mechanical advantage in dislodging the toner as the web is removed and tends to keep the dislodged toner in the center of the cover.

Although cleaning edge 54 is described as being on a protrusion is 50, it really need not protrude above the plane of the upper surface of cover 5. That is, cleaning edge 54 could be on an indentation on the surface of cover 5 which mates with a protrusion on the lower surface 17 of flange 11 which forces web 7 down into the indentation and against the cleaning edge 52.

The cleaning edge need not be on the cover if the seal engages another member in its unsealing movement. For example, although the structure shown with web 7 folded is much preferred for easy removal, if the web is not folded but pulled directly out, the cleaning edge is better placed on the lower surface of flange 11 with mating protrusions on cover 5.

The invention has been described in detail with particular reference to a preferred embodiment thereof, but it will be understood that variations and modifications can be effected within the spirit and scope of the invention as described hereinabove and as defined in the appended claims.

I claim:

1. A toner container comprising:

a containing portion for containing toner and having an opening through which toner can be dispensed and a flange extending in at least a first direction from the opening, a cover slidable in the first direction from a position covering the opening to a position uncovering the opening, and a web seal in a sealing condition over the opening and extending in the first direction between the cover and the flange and removable from the sealing condition by movement in the first direction, one of the cover and the flange having a cleaning edge positioned to scrape toner off one side of the web seal as the web seal moves in the first direction, said cleaning edge being V-shaped, with the point of the V directed in the first direction.

2. A toner container according to claim 1 wherein the web seal has a sealing portion and a portion extending in the first direction and a fold between the sealing portion and the extending portion to double the web back on itself and the cleaning edge is defined by a protrusion on the cover.

3. A toner container according to claim 2 further including cooperating protrusions on the flange extending across the path of the web, which protrusions force the web into engagement with the cleaning edge.

4. A toner container according to claim 3 wherein said protrusions on the cover and flange are in cooperating relation when the cover is in its uncovering position.

5. A toner container according to claim 4 wherein said protrusions on said flange are V-shaped, with the point of the V directed in the first direction.

* * * * *